US005996359A

United States Patent [19]

Johnson

[11] Patent Number: 5,996,359

[45] Date of Patent: Dec. 7, 1999

[54] AUTOMATIC SHUT OFF SYSTEM FOR A BEVERAGE DISPENSER

[76] Inventor: Greg A. Johnson, 16002 Gordonhill, Houston, Tex. 77095

[21] Appl. No.: 09/141,104

[22] Filed: Aug. 21, 1998

Related U.S. Application Data

[60] Provisional application No. 60/056,659, Aug. 22, 1997.

[51] Int. Cl.[6] ..... B67D 1/00

[52] U.S. Cl. ..... 62/131; 62/392; 222/63

[58] Field of Search ..... 62/131, 132, 135, 62/389, 391, 392; 222/63, 64, 65, 66, 153.01, 153.13, 74, 75

[56] References Cited

U.S. PATENT DOCUMENTS 1,764,784 6/1930 Freeman ..... 62/131

3,822,565 7/1974 Arzberger ..... 62/392

4,696,417 9/1987 Ugolini ..... 62/392 X 4,728,005 3/1988 Jacobs et al. ..... 222/65 X

*Primary Examiner*—Harry B. Tanner

*Attorney, Agent, or Firm*—Nick A. Nichols, Jr.

[57] ABSTRACT

An automatic beverage dispenser shut off system for a beverage dispenser includes a housing for a closed loop refrigeration system. A retaining tank feed system directs the beverage mix to a mixing cylinder having a rotatable beater bar mounted therein. The beater bar is coupled to a motor. The retaining tank cover is in actuating contact with a shut off switch in the power circuit of the beverage dispenser. Removal of the retaining tank cover automatically actuates the shut off switch and cuts off all power to the beverage dispenser.

3 Claims, 3 Drawing Sheets

AUTOMATIC SHUT OFF SYSTEM FOR A BEVERAGE DISPENSER

This application claims the benefit of U.S. Provisional Application No. 06/056,659, filed Aug. 22, 1997.

BACKGROUND OF THE DISCLOSURE

The present invention is directed to a beverage dispenser shut off system, particularly, a shut off system which automatically shuts off power to the beverage dispenser when it is being prepared for cleaning or service, or when beverage mix is being added to the beverage dispenser.

Equipment for dispensing beverage products such as margaritas, daiquiris, frozen lemonade, and frozen or semi-frozen fruit juices are well known in the prior art. Such devices vary from simple hand crank units used to make homemade ice cream to high capacity, high output cocktail freezers used by commercial establishments. Typically, these prior art beverage dispensers include a mixing cylinder having a beater bar mounted within the mixing cylinder. The beater bar is connected to a drive motor which rotates the beater bar within the mixing cylinder. A beverage retaining tank or hopper connected to the mixing cylinder holds the beverage mix or ingredients and delivers the beverage mix to the mixing cylinder through an opening or passageway connecting the retaining tank to the mixing cylinder.

The retaining tank must be periodically filled with new beverage ingredients when the beverage level in the retaining tank reaches a predetermined lower limit. The retaining tank and mixing cylinder must also be cleaned regularly. When these function are to be performed the beverage dispenser is turned off and preferably unplugged so that no power is applied to the beverage dispenser. These safety precautions are not always followed, thereby presenting a serious risk of injury to employees re-filing or cleaning the beverage dispenser. If the power to the beverage dispenser is not shut off, accidents may occur if the dispenser is inadvertently turned on. This is particularly dangerous when personnel are cleaning or servicing the mixing cylinder and beater bar of the dispenser.

It is therefore an object of the present invention to provide a beverage dispenser shut off system which automatically shuts off power to the beverage dispenser when it is being cleaned or services.

It is another object of the present invention to provide a beverage dispenser shut off system which is actuated upon removal of the beverage dispenser cover.

SUMMARY OF THE INVENTION

The present invention provides an automatic beverage dispenser shut off system. The beverage dispenser includes a housing for a closed loop refrigeration system which includes an evaporator, heat exchanger, condenser, compressor and a filter/dryer. A retaining tank feed system directs the beverage mix to a mixing cylinder having a rotatable beater bar mounted therein. The beater bar is coupled to a direct drive motor. The retaining tank cover is in actuating contact with a shut off switch in the power circuit of the beverage dispenser. Removal of the retaining tank cover automatically actuates the shut off switch and cuts off all power to the beverage dispenser.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other eqaully effective embodiments.

DESCRIPTION OF A PREFERRED EMBODIMENT

Figure 1:
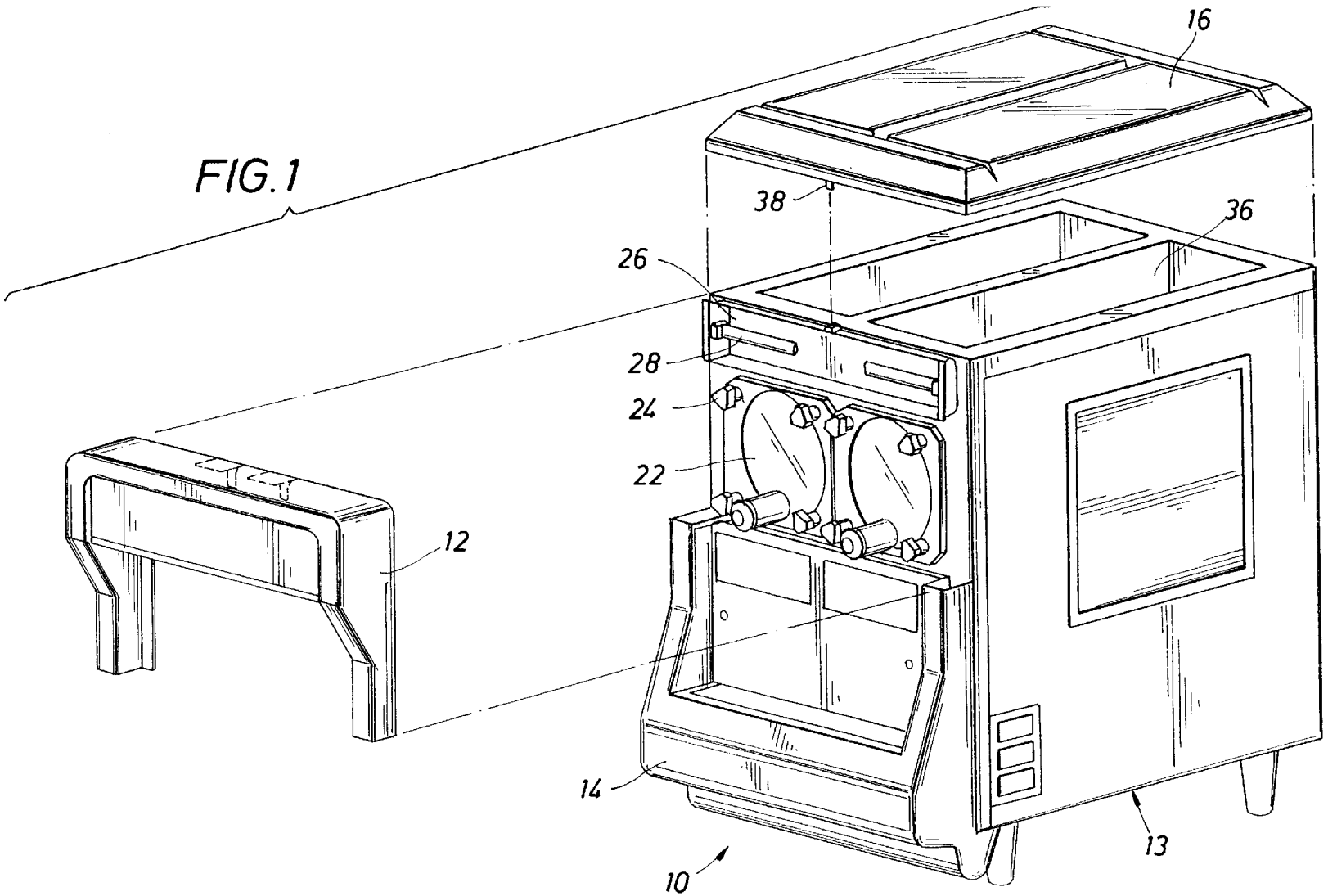
FIG. 1 is an exploded perspective view of the beverage dispenser housing of the invention.

Referring first to FIG. 1, the beverage dispenser of the invention is generally identified by the reference numeral 10. The beverage dispenser 10 includes a housing or cabinet 13 having side walls, a bottom, and front and rear walls. The front wall of the dispenser housing 13 is enclosed by a front panel which is divided into an upper panel 12 and a lower panel 14. The top of the beverage dispenser 10 is closed by a removable cover 16. The beverage dispenser 10 includes adjustable support feet 18 located adjacent each corner of the dispenser housing 13.

Figure 2:
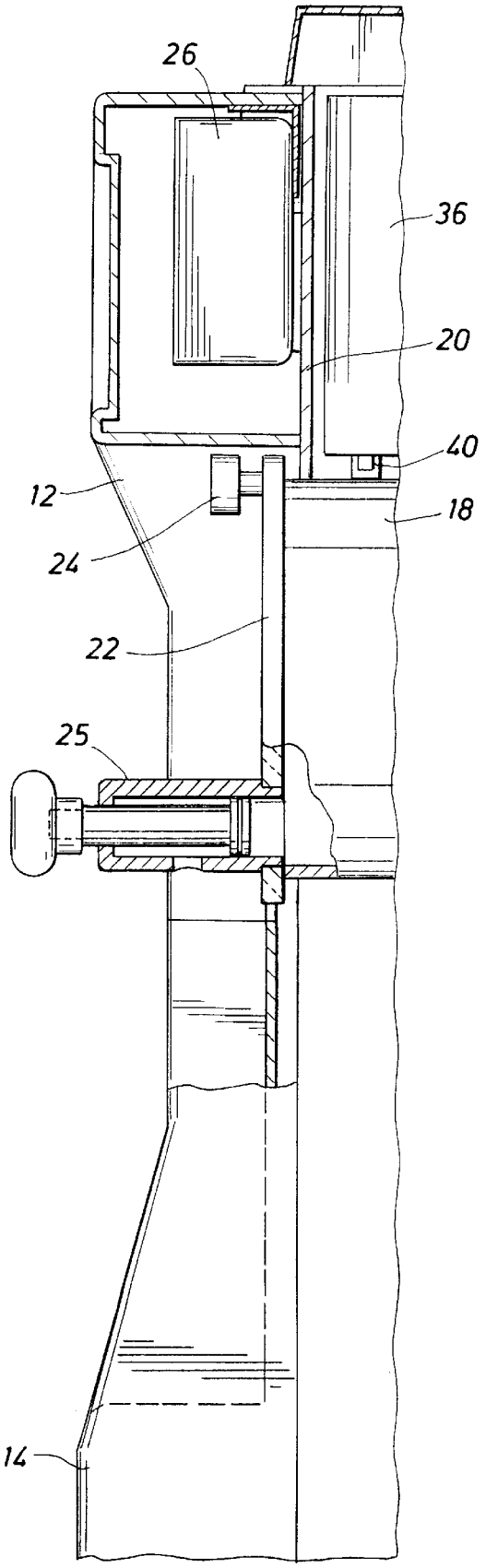
FIG. 2 is a partial cross sectional view of the beverage dispenser houseing of the invention depicting the forward portion of the dispenser housing.

Mounted within the dispenser housing 13, but not shown in the drawings, is a closed loop refrigeration system comprising a compressor, a heat exchanger, a filter/dryer and a condenser. A mixing cylinder 18, as best shown in FIG. 2, is mounted to the front wall 20 of the housing 13. The mixing cylinder 18 extends rearward of the front wall 20 into the interior of the housing 13. The forward end of the mixing cylinder 18 extends through an opening in the front wall 20 and is covered by a faceplate 22. The faceplate 22 is securely mounted to the front wall of the housing 13 by a plurality of faceplate knobs 24. A nozzle 25 projects from the faceplate 22 and is securely mounted thereon. A rotatable beater bar, operatively coupled to a drive motor mounted on the rear end of the mixing cylinder 18 (not shown in the drawings), is concentrically mounted within the mixing cylinder 18.

Referring again to FIG. 1, the upper portion of the housing 13 supports a retaining tank 36. The retaining tank 36 retains the beverage mix for deliver to the mixing cylinder 18. The retaining tank 36 is in fluid communication with the mixing cylinder 18 via a passageway 40 as best shown in FIG. 2.

Referring still to FIG. 2, a light box 26 is mounted to and extends across the upper end of the housing 13. The light box 26 is enclosed by the upper end of the front panel portion 12 when it is assembled on the front wall 20 of the housing 13. The light box 26 includes several light emitting bulbs 28 which illuminate the front of the beverage dispenser 10.

Figure 3:
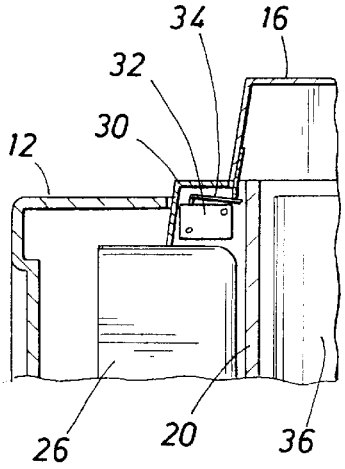
FIG. 3 is a partial sectional view depicting the shut off switch of the invention.

Referring now to FIG. 3, it will be observed that the light box 26 includes an upstanding flange 30 which extends through a slot formed in the upper end of the panel 12. The flange 30 supports a shut off switch 32 which is mounted thereon. The switch 32 includes a contact 34 which is biased upwardly in a open position. When the contact 34 of the switch 32 is open, the circuit from the power supply to the dispenser refrigeration system and drive motor is broken and power to the beverage dispenser 10 is shut off.

Figure 4:
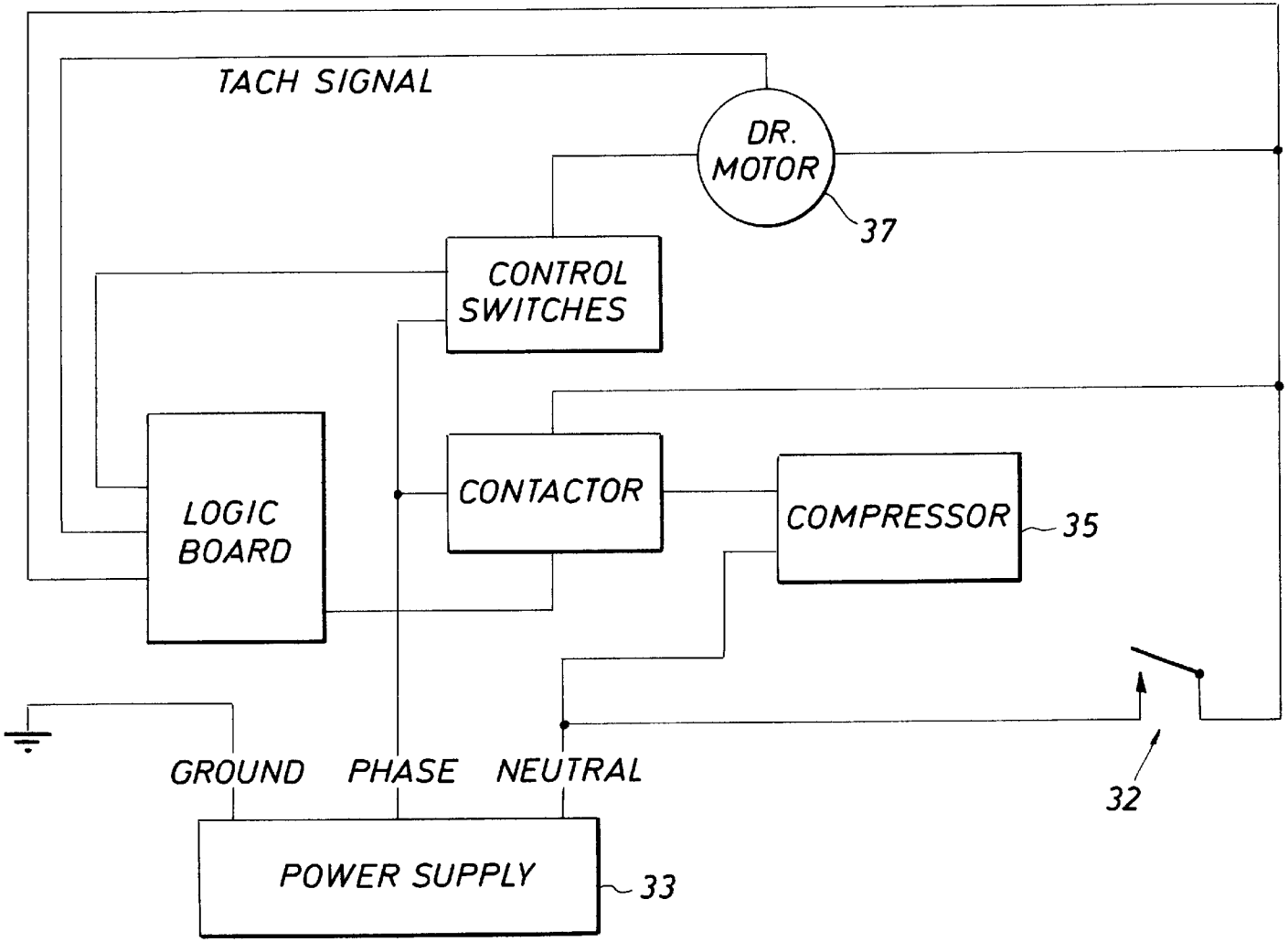
FIG. 4 is a simplified block diagram depicting the power shut off system of the invention.

In FIG. 4, a simple block diagram of the power circuit of the invention is shown. The circuit includes the switch 32 electrically connected to a power supply 33, compressor 35 and motor 37. It will be observed that when the switch 32 is in the open position shown in FIG. 4, the circuit is broken and thus power to the motor 37 is automatically shut off.

Referring now to FIGS. 2 and 3, when the cover 16 is positioned on top of the housing 13 covering the retaining tank 36, a downwardly protruding tab 38 located on the front edge of the cover 16 engages the contact 34 of the switch 32 forcing it to the closed position to complete the circuit, and thereby delivering power to the drive motor and other components housed within the housing 13. When the cover 16 is removed, the contact 34 springs upward, breaking the circuit and automatically shutting off power to the beverage dispenser 10. This automatic shut off feature ensures that power to the dispenser 10 is cut off every time the cover 16 is removed for filling the retaining tank 36 or servicing of the dispenser 10 so that accidental injuries by the unexpected actuation of the power system of the dispenser 10 is avoided.

While the foregoing is directed to the preferred and illustrated embodiments of the invention, other and further embodiments of the invention may be devised without departing from the basic scope thereof, which scope thereof is determined by the claims which follow.

I claim:

1. A beverage dispenser having a refrigeration system mounted within a dispenser housing, a beverage retaining tank mounted in said housing in fluid communication with a mixing cylinder having a beater bar rotatably mounted within said mixing cylinder and connected to drive motor means, the improvement comprising shut off switch means for automatically turning off the power supply to said beverage dispenser upon removal of the retaining tank cover.

2. The beverage dispenser of claim 1 wherein said switch means is connected to the neutral drive motor contact.

3. The beverage dispenser of claim 1 wherein said tank cover includes a downwardly projecting actuating tab in contact with said switch means to complete the power circuit of said beverage dispenser.

* * * * *